US008758158B2

(12) United States Patent
Jennings

(10) Patent No.: US 8,758,158 B2
(45) **Date of Patent: *Jun. 24, 2014**

(54) FLEXIBLE GOLF CLUB HEAD

(71) Applicant: Joseph Jennings, Sarasota, FL (US)

(72) Inventor: Joseph Jennings, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,619

(22) Filed: May 14, 2013

(65) Prior Publication Data

US 2014/0024474 A1 Jan. 23, 2014

Related U.S. Application Data

(60) Provisional application No. 61/672,389, filed on Jul. 17, 2012.

(51) Int. Cl.
*A63B 53/02* (2006.01)

(52) U.S. Cl.
USPC ..... 473/316; 473/282; 473/305

(58) Field of Classification Search
CPC ..... A63B 59/00; A63B 59/0092; A63B 2059/0081
USPC ..... 473/219, 223, 232, 226, 457, 305, 307, 473/310–323, 282
See application file for complete search history.

(56) References Cited

U.S. PATENT DOCUMENTS

| | | | | | |
|---|---|---|---|---|---|
| 1,985,427 | A * | 12/1934 | Richardson | 403/223 |
| 3,341,202 | A * | 9/1967 | Stars | 473/282 |
| 4,809,983 | A | 3/1989 | Langert | |
| 4,854,585 | A | 8/1989 | Koch et al. | |
| 4,856,782 | A | 8/1989 | Cannan | |
| 5,205,561 | A | 4/1993 | Lux | |
| 5,226,652 | A * | 7/1993 | Sato | 473/312 |
| 5,338,035 | A | 8/1994 | Lyford | |
| 5,362,048 | A * | 11/1994 | Haste | 473/313 |
| 5,451,048 | A | 9/1995 | Magamoto et al. | |
| 5,735,752 | A * | 4/1998 | Antonious | 473/317 |
| 5,971,865 | A * | 10/1999 | Shenoha et al. | 473/316 |
| 6,045,457 | A * | 4/2000 | Soong | 473/318 |
| 6,050,903 | A * | 4/2000 | Lake | 473/244 |
| 6,257,992 | B1 | 7/2001 | LeBlanc | |
| 6,558,267 | B2 * | 5/2003 | Novosel, Sr. | 473/232 |
| D518,128 | S | 3/2006 | Ramos | |
| 7,040,999 | B2 | 5/2006 | Trainello | |
| 2005/0176521 | A1 * | 8/2005 | Burch et al. | 473/305 |
| 2006/0264266 | A1 * | 11/2006 | Jung | 473/282 |

* cited by examiner

*Primary Examiner* — Nini Legesse
(74) *Attorney, Agent, or Firm* — Buckingham, Doolittle & Burroughs, LLC

(57) ABSTRACT

An improved golf club shaft comprised of a flexible insert device that adds additional flexibility to said club shaft and creates one or more pivot points along said shaft. The increased flexibility of the golf club shaft enables a golfer to impart greater force on a golf ball, and also dampens or reduces the amount of vibration and/or shock otherwise imparted to the golfer when the golf club head strikes the golf ball.

16 Claims, 4 Drawing Sheets

FLEXIBLE GOLF CLUB HEAD

CROSS-REFERENCE

This application claims priority from Provisional Patent Application Ser. No. 61/672,389 filed on Jul. 17, 2012, and is a continuation in part of non-provisional patent application Ser. No. 13/778,885 filed on Feb. 27, 2013 which, in turn, claims the benefit of U.S. Provisional Patent Application Ser. No. 61/656,050 filed on Jun. 6, 2012.

FIELD OF THE INVENTION

This invention relates to an improved golf club that enables the user to increase the force imparted on the golf ball by the golf club, while reducing the shock to the user resulting from the impact of the club striking the ball. More specifically, the improved golf club may be comprised of at least one non-rigid shaft insert that adds flexibility to the golf club shaft and enables the user to apply more force to the golf ball when swinging the golf club, while also reducing the amount of shock imparted to the individual when the club makes contact with the ball. In an alternative embodiment of the present invention, a substantial portion of the shaft may be comprised of a flexible insert.

BACKGROUND

Many individuals enjoy playing golf, and power, timing and focus are but a few of the skills that are imperative to the game of golf. However, some golfers put so much emphasis on the timing of their golf swing that they do not hit the golf ball with enough power. Other golfers overemphasize the need for power and swing too hard, thereby sacrificing the timing of their golf swing.

Additionally, traditional golf club are typically constructed of relatively rigid, hollow or solid golf club shafts, which are oftentimes comprised of graphite, plastic, fiberglass and the like. However, because these prior art designs are relatively rigid, a vibration or shock tends to travel up the club shaft and to the user when the golf club strikes the golf ball. Therefore, golfers may not be able to strike the golf ball very hard, especially if the individual is new to the sport and/or does not possess good form when swinging the golf club. This may be frustrating for the golfer, and discourage the individual from continuing with the sport and progressing. Additionally, prolonged exposure of the individual to the shock and/or vibrations generated by existing golf club shaft designs could lead to injury, such as stress fractures and the like.

Consequently, there exists in the art a long-felt need for an improved golf club shaft that is relatively flexible and that enables a golfer to impart greater force on a golf ball with a golf club, thereby improving the user's play and making the game more enjoyable. There also exists in the art a long felt need for an improved golf club shaft that dampens or reduces the amount of vibration and/or shock otherwise imparted to an individual holding a golf club when the golfer strikes the golf ball, thereby reducing the likelihood of injury and making the game more enjoyable. Finally, there is a long-felt need for an improved golf club shaft that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later. This application is a continuation in part of non-provisional patent application Ser. No. 12,778,885, filed on Feb. 27, 2013, which is incorporated herein by reference.

The subject matter disclosed and claimed herein, in one aspect thereof, is a relatively flexible golf club shaft that enables a user to impart greater force on a golf ball with the golf club while also dampening or reducing the amount of vibration and/or shock to the individual holding the golf club when the club strikes the golf ball. The improved golf club is preferably comprised of a club shaft comprising a first portion and a second portion, a handle positioned along said first portion and a club head positioned on said second portion, and at least one relatively flexible insert positioned along said club shaft between the first and second portions and preferably between ½ and 2 inches away from the club head. Flexible insert is preferably comprised of a flexible material such as rubber, reinforced rubber, plastic or the like, and may contain one or more threaded openings for receipt of corresponding threaded male portions that extend from the club shaft. Conversely, it is also contemplated that the flexible insert could be comprised of one or more male portions for insertion into openings in the club shaft, or a combination of an opening and a male portion. In an alternative embodiment of the present invention, the flexible insert may extend along a longer length of the golf club shaft.

The flexible inserts of the present invention add a greater degree of flexibility to the golf club shaft and enable a golfer to impart greater force on a golf ball with the golf club, while also dampening or reducing the amount of vibration and/or shock to the individual holding the golf club when the club strikes the golf ball. Finally, the improved golf club shaft of the present invention accomplish all of the forgoing objectives and is relatively inexpensive to manufacture, and safe and easy to use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

Figure 5:
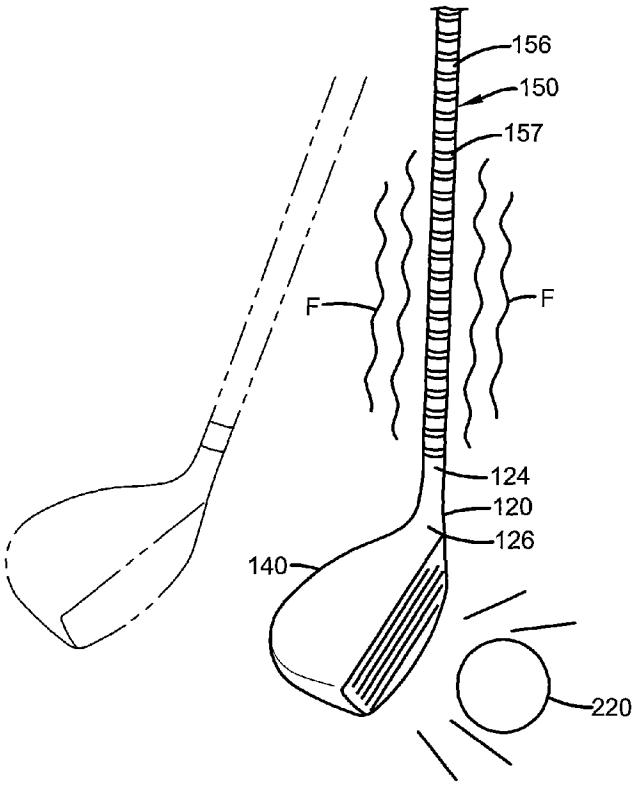

FIG. 5 illustrates a perspective view of an alternative embodiment of the present invention striking a golf ball with the curved arrows graphically representing the vibration and/or shock generated by the golf club striking the golf ball being dissipated along the flexible insert portion of the club shaft.

The above referenced FIGS. are not necessarily to scale, but are offered for illustrative purposes.

DETAILED DESCRIPTION

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Figures 1, 1A:
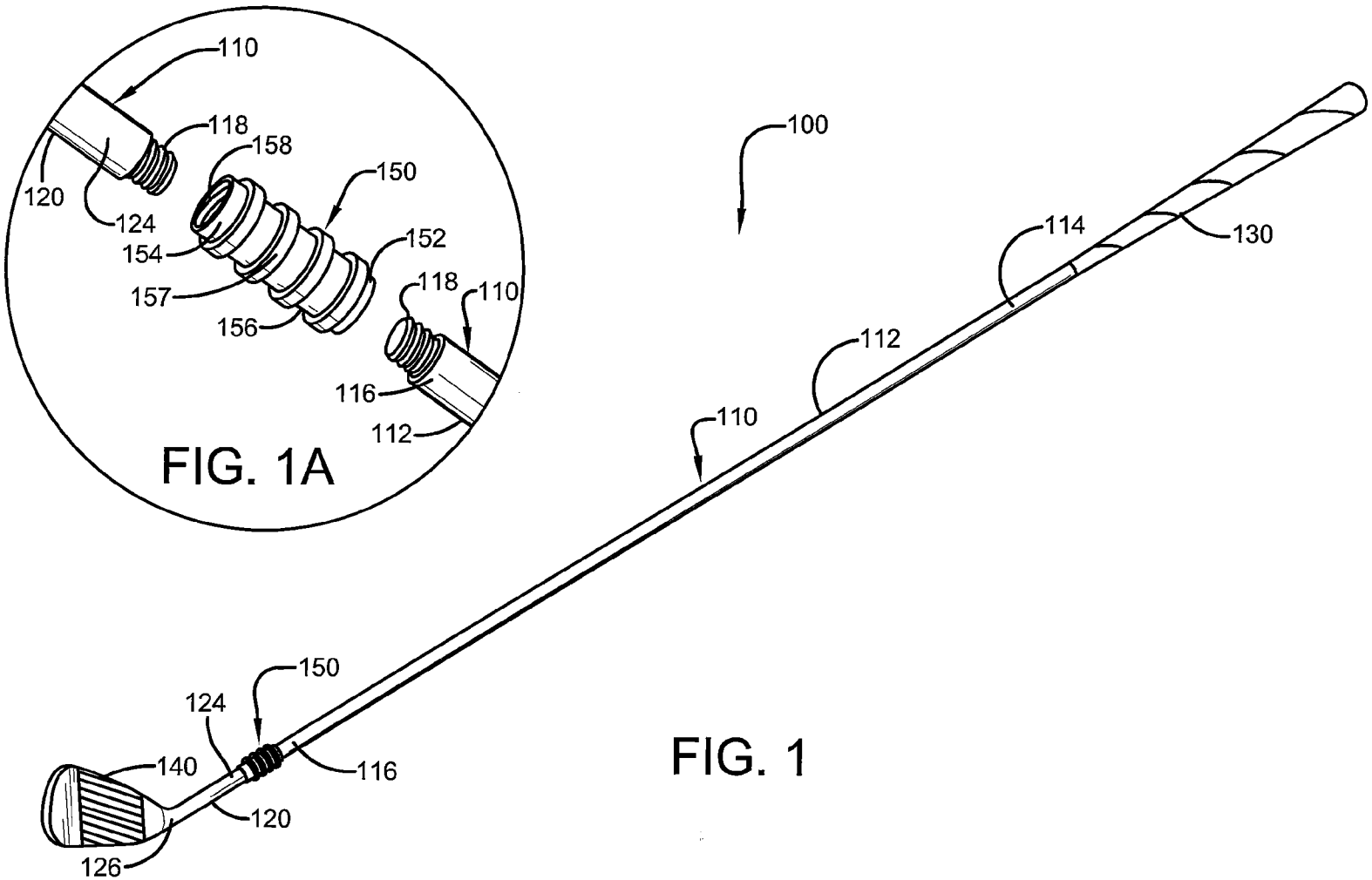
FIG. 1 illustrates a perspective view of a preferred embodiment of the golf club of the present invention.
FIG. 1A illustrates a close-up exploded perspective view of the flexible insert shown in FIG. 1, and its relationship with portions of the golf club shaft.

Referring initially to the drawings, FIG. 1 illustrates a perspective view of a preferred embodiment of the golf club 100 of the present invention. Club 100 is preferably comprised of a shaft 110, a handle 130, a club head 140 and a relatively flexible insert 150 positioned along shaft 110. Shaft 110 is an elongated member comprised of graphite, fiberglass, plastic, metal or any other material commonly used for constructing golf club shafts. In a preferred embodiment of the present invention shaft 110 is further comprised of a first portion 112 and a second portion 120. First portion 112 is comprised of an inboard end 114, which is located nearest handle 130 as described below, and an outboard end 116, which is located nearest flexible insert 150. Likewise, second portion 120 is also comprised of an inboard end 124, which is located nearest flexible insert 150 as described below, and an outboard end 126, which is located nearest club head 140.

Handle 130 may be any golf club handle known in the art and is used by the user to hold or grip golf club 100. Handle 130 may be integrally formed or securely attached to first portion 112, adjacent to inboard end 114, as best illustrated in the FIGS. The overall dimensions, texture and style of handle 130 may be manufactured to suit user need and/or a particular application, and does not form an integral part of the present invention. For example, handle 130 may be further comprised of rubber, tape, or other well known material for improving a user's (not shown) grip on golf club 100.

The overall length of first portion 112, as measured between inboard end 114 and outboard end 116 is preferably between 30 and 40 inches (depending on the length of the overall shaft and type of golf club), and the overall length of second portion 120, as measured between inboard end 124 and outboard end 126 is preferably between ½ and two inches. Nonetheless, it is contemplated that other dimensions could also be used for first portion 112 and second portion 120. Indeed, FIG. 2, which depicts an alternative embodiment of the present invention, discloses a relative long flexible insert 150, and relatively shorter first portion 112.

Club head 140 may be any golf club head commonly known in the art, such as a driver head, a "wood" head, an "iron" head, or a putter head. Club heads are well known in the art, and the selection, sizing, style or ornamentation of club head 140 is not anticipated to impact the overall concept of the present invention. In fact, it is contemplated that the improved shaft 110 of the present invention will function well with virtually any type of golf club head 140.

Flexible insert 150 is preferably formed of a flexible material such as rubber, reinforced rubber, plastic or the like, and may comprise a first end 152, a second end 154, an exterior surface 156 and a plurality of spaced apart ribs 157 positioned along the exterior surface 156 to add strength to flexible insert device 150. As best illustrated in FIG. 1A, flexible insert device 150 may be comprised of an opening 158 (e.g., a threaded opening) in said first and second ends 152, 154 for receipt of male inserts 118 (e.g., threaded male inserts) that may extend from the outboard end 116 of first portion 112 and the inboard end 124 of second portion 120. Conversely, it is also contemplated that flexible insert 150 could comprise male portions (not shown) extending outwardly from both of said first and second end 152, 154 (also not shown) for insertion into corresponding openings in outboard end 116 of first portion 112 and the inboard end 124 of second portion 120, respectively, or a combination of a male portion (not shown) and an opening 158.

Flexible inserts 150 may be manufactured with different degrees of flexibility to suit user need and/or preference. In this manner, as a club user progresses in his or her development as a golfer, the user can increase or decrease the flexibility of his or her golf club 100 by using inserts 150 with different degrees of flexibility with the same golf club 100, as opposed to having to purchase a new golf club or set of clubs each time the user desires to make a change in the flexibility of the club shaft 110.

Figure 2:
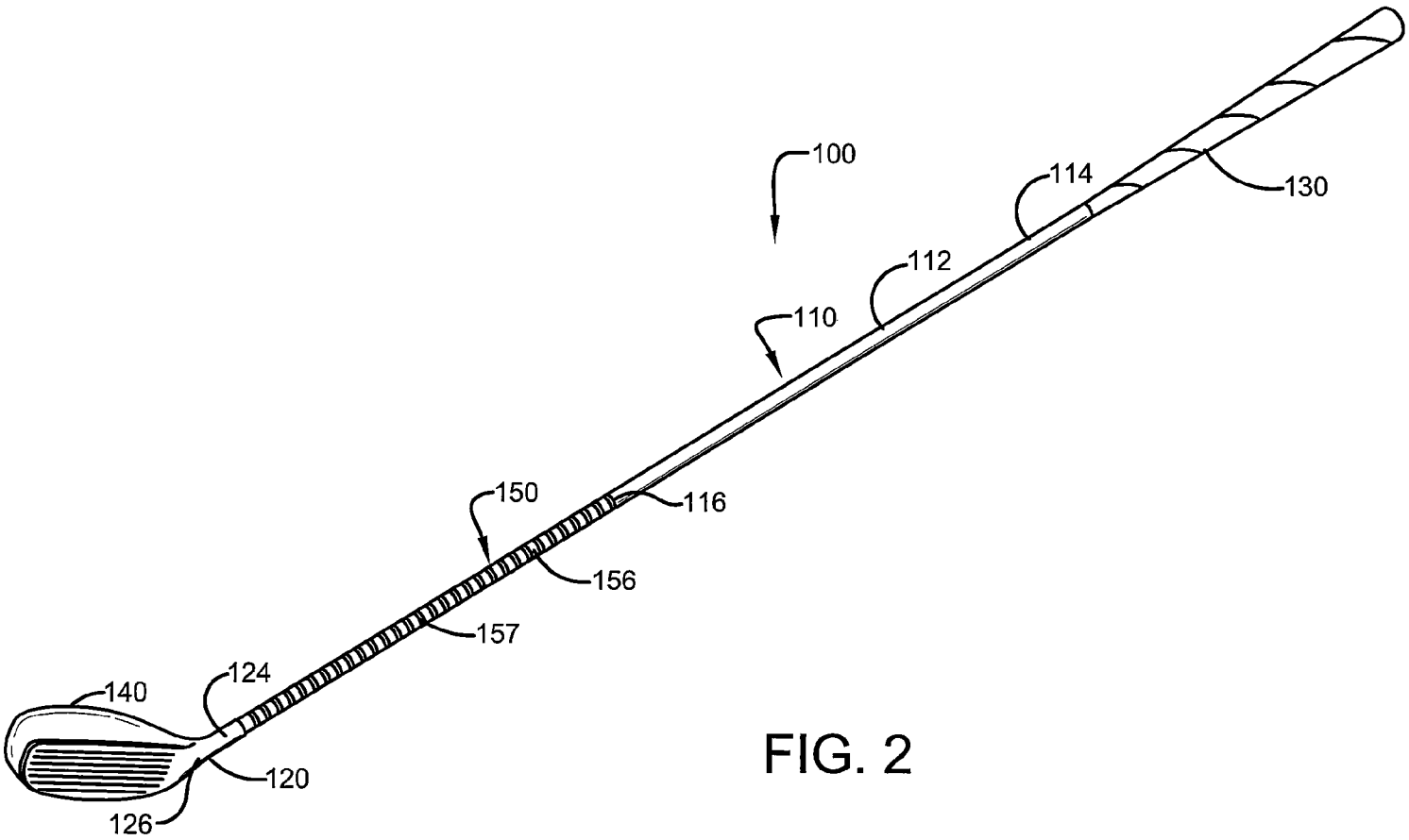
FIG. 2 illustrates a perspective view of an alternative embodiment of the golf club of the present invention.

In a preferred embodiment of the present invention, the size and cross-sectional shape of flexible insert 150 should compliment the general size and cross-sectional shape of shaft 110. More specifically, the overall length of flexible insert 150 in the preferred embodiment, as measured between first end 152 and second end 154, is preferably between one and three inches. However, as illustrated in FIG. 2, it is also contemplated that flexible insert 150 could be substantially longer in an alternative embodiment, such as between six and 20 inches in length.

Further, the size and shape of male inserts 118 extending outwardly from outboard end 116 of first portion 112 and inboard end of 124 of second portion 120 should correspond with the general size and shape of openings 158 in flexible insert 150 so as to friction fit or thread therewithin. Once assembled, first and second portions 112, 120 of shaft 110 will be securely attached to one another and separated by flexible insert device 150, as best shown in FIGS. 1 and 2. Further, flexible insert 150 will serve as a flex or pivot point that provides golf club 100 with greater flexibility than prior art golf club shafts, which are typically integrally formed without a flex or pivot point. The increase in flexibility allows more pivotal movement of golf club head 140 relative to handle 130 during a typical golf swing, which results in greater force being imparted to the golf ball. As explained more fully below, the increased flexibility also absorbs more of the shock present along a golf club handle when the golf club makes contact with the golf ball.

Figure 3:
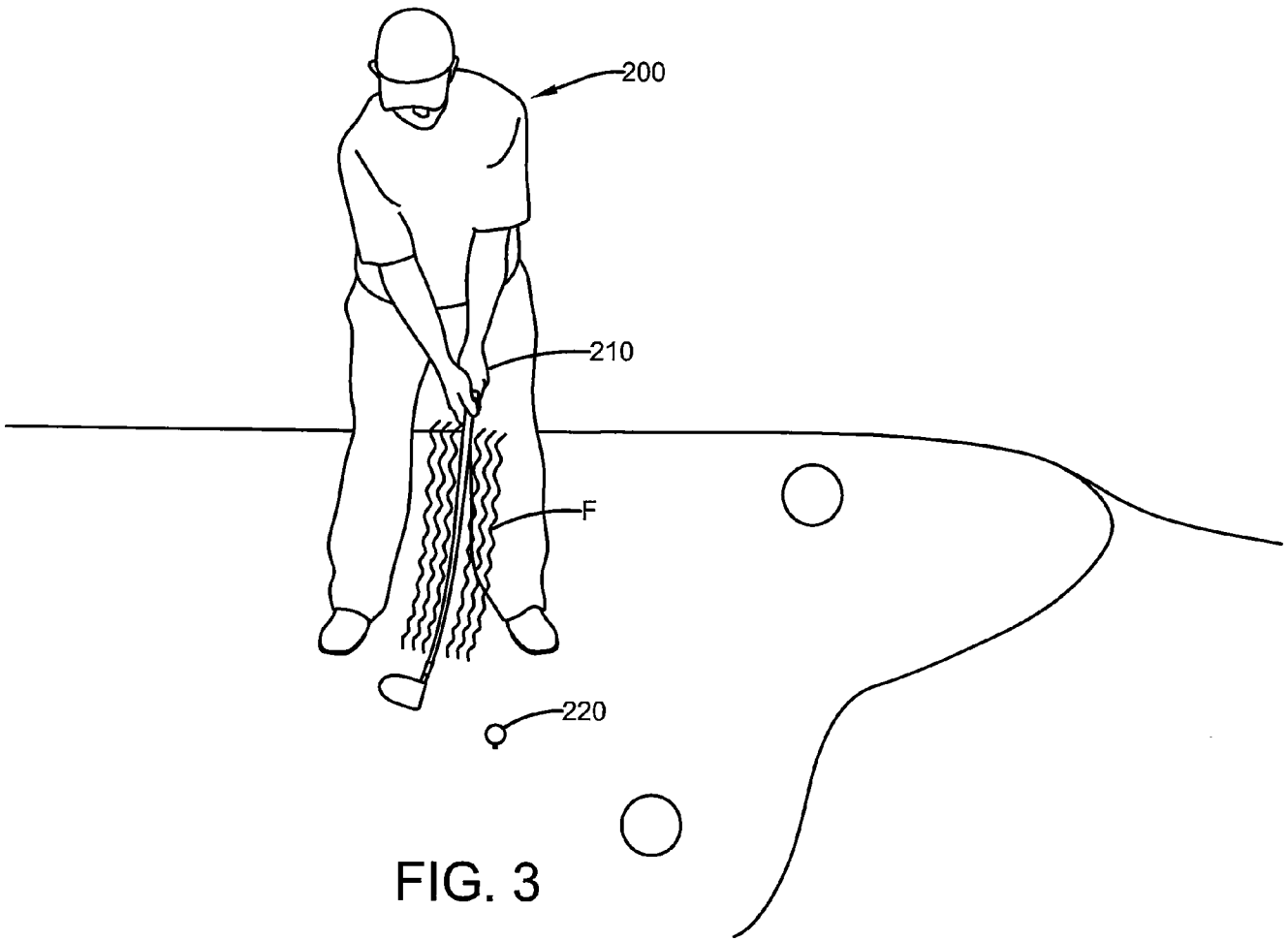
FIG. 3 illustrates a perspective view of a prior art golf club striking a golf ball with the curved arrows graphically representing the vibration and/or shock generated by the golf club striking the golf ball being transferred to the user's hand.

FIG. 3 illustrates a golfer 200 using a prior art golf club 10 to strike a golf ball 220. Due to the relatively rigid nature of prior art golf club 10, as the club head makes contact with golf ball 220, a vibration or force F is generated and travels up the length of the golf club shaft and handle and to the golfer's hand 210, which may result in discomfort or possible injury to the golfer 200. The resulting discomfort or possibility of injury may, in turn, cause golfer 200 to strike golf ball 220 with less force than golfer 200 is otherwise capable of, thereby impacting the golfer's performance and/or enjoyment of the game.

Figure 4:
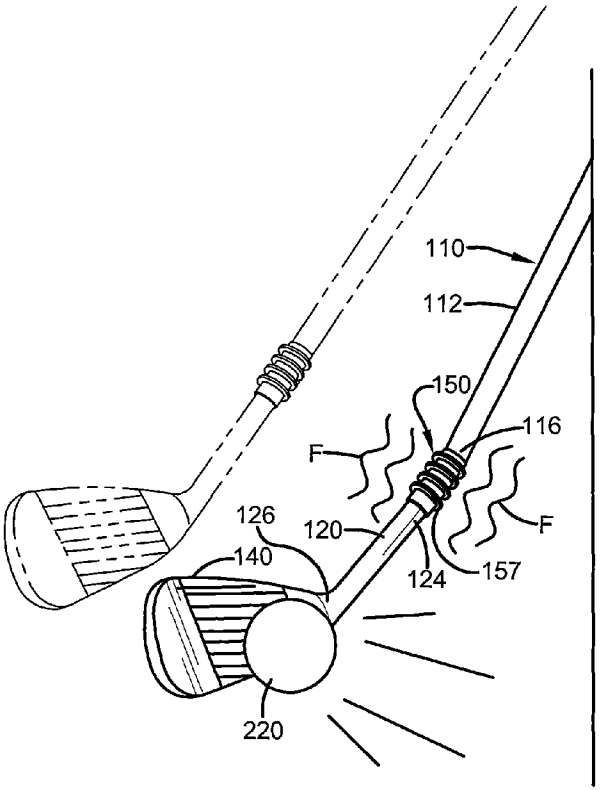
FIG. 4 illustrates a perspective view of the preferred embodiment of the present invention striking a golf ball with the curved arrows graphically representing the vibration and/ or shock generated by the golf club striking the golf ball being dissipated by the flexible insert.

By comparison, FIG. 4 illustrates a perspective view of a user 200 using a preferred embodiment of club 100 to strike a golf ball 220 with the curved arrows graphically representing the vibration and/or shock generated by the golf club 100 striking the golf ball 220 being substantially dissipated by the presence of flexible insert 150. Similarly, FIG. 5 illustrates a perspective view of a user 200 using an alternative embodiment of club 100 (i.e., with a substantially longer flexible insert 150 installed along shaft 100) to strike a golf ball 220 with the curved arrows graphically representing the vibration and/or shock generated by the golf club 100 striking the golf ball 220 being substantially dissipated by the presence of the longer flexible insert 150. Importantly, both embodiments of flexible insert 150 serve as flex or pivot points that provide golf club shaft 110 with greater flexibility than prior art golf club shafts, which are typically integrally formed without a flex or pivot point. The increase in flexibility allows more pivotal movement of golf club head 140 relative to handle 130 during a typical golf swing, which results in greater force being imparted to the golf ball.

It should also be appreciated that the combined structure of the improved golf club shaft 110 with flexible insert 150 also permit the golfer to use the improved golf club shaft 110 with a plurality of interchangeable golf club heads 140, such as driver heads, "wood" heads, "iron" heads, and putter heads. More specifically, a golfer 200 desiring to use a different club head 140 could simply remove the existing second portion 120 and club head 140 by, for example, disconnecting the second portion 120 from flexible insert 150 and replacing the same with an alternative second portion 120 attached to different type of club head 140. In this manner, a golfer may experience the benefits of utilizing many different shapes, sizes and types of club heads 140 without incurring the expense and storage requirements associated with owning multiple sets of golf clubs.

Consequently, improved golf club 100 includes a shaft portion that is relatively flexible and that enables a user to impart greater force on a golf ball, thereby improving the golfer's play and making the game of golf more enjoyable. The improved golf club shaft and flex point located thereon also dampens or reduces the amount of vibration and/or shock otherwise imparted to a golfer holding a golf club when the club strikes the golf ball, thereby reducing the likelihood of injury and making the game more enjoyable. Additionally, the combined structure of the improved golf club shaft and flexible insert device permits a golfer to use the improved golf club shaft with a plurality of interchangeable golf club heads, thereby sparing the golfer the expense and storage requirements associated with owning multiple sets of golf clubs and/or shafts. Finally, the improved golf club shaft is relatively inexpensive to manufacture, and safe and easy to use.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An improved golf club shaft comprising:

a first portion and a second portion wherein at least one of said first portion and said second portion further comprise a threaded male portion;

a flexible insert positioned between said first portion and said second portion, wherein said flexible insert is comprised of rubber and a threaded opening for receipt of said threaded male portion; and a club head connected to said second portion.

2. The improved golf club shaft of claim 1 wherein said first portion is removably attached to said second portion by said flexible insert.

3. The improved golf club shaft of claim 1 wherein said flexible insert comprises at least one opening therein for receipt of a male insert extending longitudinally from at least one of said first portion and said second portion.

4. The improved golf club shaft of claim 1 wherein the flexible insert is further comprised of a first end and a second end and the overall length of the flexible insert, as measured between said first and second ends, is between one and three inches.

5. The improved golf club shaft of claim 1 wherein the flexible insert is further comprised of an exterior surface and a plurality of ribs located on said exterior surface.

6. An improved golf club comprising:

a handle;

a club shaft comprised of a first portion, a second portion, wherein at least one of said first portion and said second portion further comprise a threaded male portion;

a flexible insert positioned between said first portion and said second portion, wherein said flexible insert is comprised of rubber and a threaded opening for receipt of said threaded male portion; and a club head connected to said second portion.

7. The improved golf club of claim 6 wherein said first portion is removably attached to said second portion by said flexible insert.

8. The improved golf club of claim 6 wherein said flexible insert comprises at least one opening therein for receipt of a male insert extending from at least one of said first portion and said second portion.

9. The improved golf club of claim 6 wherein the flexible insert is further comprised of a first end and a second end and the overall length of the flexible insert, as measured between said first and second ends, is between one and three inches.

10. The improved golf club of claim 6 wherein the flexible insert is further comprised of a first end and a second end and the overall length of the flexible insert, as measured between said first and second ends, is between six and twenty inches.

11. The improved golf club of claim 6 wherein the flexible insert is further comprised of an exterior surface and a plurality of ribs located on said exterior surface.

12. The improved golf club of claim 6 wherein the flexible insert is positioned between ½ and two inches away from the club head and forms a pivot point in the club shaft.

13. The improved golf club of claim 6 wherein said club head is interchangeable with a second golf club head.

14. An improved golf club shaft comprising:

a first portion with a first threaded opening therein;

a second portion with a second threaded opening therein; and a pivot point in said improved golf club shaft located between the first portion and the second portion, wherein said pivot point is comprised of rubber, a first threaded male portion extending longitudinally therefrom for insertion into said first threaded opening, and a second threaded male portion extending longitudinally therefrom for insertion into said second threaded opening and further wherein the overall length of said pivot point is between six and twenty inches.

15. The improved golf club shaft of claim 14 further comprising a handle on a first end of said improved golf club shaft and a golf club head on a second end of said improved golf club shaft.

16. The improved golf club shaft of claim 15 wherein said pivot point enables said golf club read to rotate relative to said handle.

* * * * *